US006319323B1

(12) United States Patent
Gibson et al.

(10) Patent No.: US 6,319,323 B1
(45) Date of Patent: Nov. 20, 2001

(54) SYSTEM AND METHOD FOR ADJUSTING A WORKING DISTANCE TO CORRESPOND WITH THE WORK SURFACE

(75) Inventors: Gregory M. Gibson, Dallas; Altaf A. Poonawala, Flower Mound; John E. Hawes, Grapevine; Darwin R. Frerking, Garland; Zi-Qin Wang, Richardson, all of TX (US)

(73) Assignee: FAStar, Ltd., Dallas, TX (US)

( * ) Notice: Subject to any disclaimer, the term of this patent is extended or adjusted under 35 U.S.C. 154(b) by 0 days.

(21) Appl. No.: 09/227,459

(22) Filed: Jan. 8, 1999

(51) Int. Cl.[7] ..... B05C 11/00
(52) U.S. Cl. ..... 118/680; 118/671
(58) Field of Search ..... 118/671, 676, 118/677, 679, 680, 712, 713; 73/1.79, 1.81; 700/41, 42, 196, 77, 172, 195, 283, 121, 123, 129, 240; 702/97, 158; 901/43

(56) References Cited

U.S. PATENT DOCUMENTS

| | | | | |
|---|---|---|---|---|
| 4,602,540 | * | 7/1986 | Murofushi et al. | 82/2 B |
| 4,930,440 | | 6/1990 | Shirono | 118/663 |
| 5,147,462 | | 9/1992 | Wollam | 118/679 |
| 5,411,589 | | 5/1995 | Yoshida et al. | 118/688 |
| 5,415,693 | | 5/1995 | Yoneda et al. | 118/664 |

OTHER PUBLICATIONS

PCT Written Opinion (PCT/US99/00492) dated Feb. 2, 2001.

* cited by examiner

*Primary Examiner*—Brenda A. Lamb
(74) *Attorney, Agent, or Firm*—Fulbright & Jaworski L.L.P.

(57) ABSTRACT

The inventive mechanism adjusts a working distance between a tool and a work surface. The provision for automatically setting and adjusting the working distance between two parts of an apparatus, possibly a coating apparatus, permits the mechanism to adjust in real time for unknown and possibly random variations in the dimensions of the work surface, the apparatus supporting the work surface, and imperfect leveling of the tool or the work surface. In a preferred embodiment, the inventive mechanism is used to accurately set and maintain the working distance of a dispenser above a substrate so as to provide that a consistent coating thickness is applied across the substrate. The mechanism preferably employs direct precision distance sensing means independent of the motor of drive means to continuously measure the working distance in real time with a high degree of resolution and accuracy. When the sensor reports that the working distance has deviated from the ideal setting, a control system employs a standard P.I.D. control scheme to precisely restore the ideal working distance. The mechanism may perform the working distance control function using the main or host software, or, more preferably delegate this function to a dedicated processor for the duration of the process during which working distance is being precisely adjusted. The host preferably resumes control of the drive means in the direction of the working distance once the precision adjustment scheme is concluded, and may then perform larger scale motion of the tool using feedback from the position reporting means integral to the motor or drive means.

36 Claims, 3 Drawing Sheets

SYSTEM AND METHOD FOR ADJUSTING A WORKING DISTANCE TO CORRESPOND WITH THE WORK SURFACE

REFERENCE TO RELATED APPLICATIONS

The present application is being concurrently filed with commonly assigned U.S. patent application, Ser. No. [54183-P003US-986100-] entitled "INTELLIGENT CONTROL FOR EXTRUSION HEAD DISPENSEMENT"; U.S. patent application, Ser. No. [54183-P008US-986104] entitled "LINEAR DEVELOPER"; U.S. patent application, Ser. No. [54183-P0013US-986100] entitled "MOVING HEAD, COATING APPARATUS AND METHOD"; U.S. patent application, Ser. No. [54183-P0014US-987565] entitled "SYSTEM AND METHOD FOR INTERCHANGEABLY INTERFACING WET COMPONENTS WITH A COATING APPARATUS"; U.S. patent application, Ser. No. [54183-P0015US-987566] entitled "SYSTEM AND METHOD FOR CLEANING AND PRIMING AND AN EXTRUSION HEAD"; the disclosures of which are incorporated herein by reference. Reference is also made to the following co-pending and commonly assigned U.S. Patent Application entitled "LINEAR EXTRUSION COATING SYSTEM AND METHOD, Ser. No. 09/148,463, filed Sep. 7, 1998; and U.S. Patent Application entitled "SYSTEM AND METHOD FOR PROVIDING COATING OF SUBSTRATES, Ser. No. 09/201,543, filed Nov. 30, 1998; the disclosures of which are incorporated herein by reference.

TECHNICAL FIELD

The invention relates to automatic adjustment of working distance between a tool and a work surface.

BACKGROUND

It is often necessary or desired to provide a coating of a particular substrate. For example, in the video electronics industry it is often desired to coat panels which will serve as flat panel displays (FPD) to be incorporated into television sets, computer monitors and the like. It is important in such applications to ensure the accuracy and consistency of coating thicknesses across the panel.

A commonly employed method of coating flat panel displays is to have a stationary head extruding fluid at a particular rate over linearly moving panels however, moving heads are also used. Using such a configuration, the coating consistency is affected by a number of parameters such as the gap between the head and the panel surface, the variation in this gap as the panel moves, the dimensional consistency of the panel, the mechanical tolerances of the slot in the dispensing head, the pump characteristics and the fluid flow in the gap between the slot and the panel.

In prior art systems, variation in the height of the dispenser or extrusion head with respect to the panel can cause breaking of the coating bead and/or variation in coating thickness. The causes of such height variation include part dimension variation, part placement error, and gradual drift in machine dimensions over time. Accordingly, there is a need in the art for a system and method for ensuring constant height or "head gap" of a dispenser or extrusion head over a substrate being coated.

An independent contributor to possible variation in the height of the dispenser or dispensing head with respect to the substrate stems in fact from variation in machine dimensions rather than just variations in part placement and part dimensions. This variation in machine dimensions can result from a slow drift in mechanical dimensions over time, such as from the gradual bending of metal parts, or wearing of certain surfaces. The variation may also arise from thermal cycling causing expansion and contraction, and "settling" of surfaces/bearings under gravity.

Yet another possible contributor to possible variation in the height of a dispenser over the substrate to be coated could be variation in vertical position of the chuck holding the substrate along the direction of relative travel between the dispenser and the substrate.

Two separate problems should be distinguished here. There is the initial problem of establishing an accurate head gap when preparing for a coating operation. It is one problem in the art that variation in this initial head gap can exist between different coating runs. Separately, once this head gap has been initially established, there is the problem of accurately maintaining this head gap throughout a single coating process.

Prior art methods for solving the stated problems have involved manually inserting shims of varying thicknesses to set the head gap. This approach is deficient for several reasons. Although a head might be accurately established when the shims are first inserted, gradual drift in the dimensions of machine parts and the connections between them can cause the head gap to gradually change. It is important to note here that head gap changes of a few microns can adversely affect the coating bead.

A further problem with the prior art shim method is that even if the head is initially established with sufficient accuracy, the shims cannot compensate for subsequently introduced head gap variation arising from dimensional variation in the substrate or the chuck, part misplacement, or imperfect leveling of the substrate or supporting equipment. Therefore the manually inserted shims do not address the issue of maintaining the head gap throughout a coating process.

Therefore there is a need in the art for a system and method for accurately establishing the initial head gap in a coating apparatus prior to beginning a coating operation.

There is a further need in the art for a system and method for establishing the head gap which is independent of gradual change in the dimension and position of parts of the coating apparatus over time.

There is a still further need in the art for a system and method for accurately maintaining a properly established initial head gap throughout the performance of a coating operation.

There is a still further need in the art for a system and method for accurately maintaining a head gap throughout a coating operation independent of variation in dimensions of the part to be coated, error in part placement, and imperfect leveling of the structure supporting the part to be coated.

SUMMARY OF THE INVENTION

These and other objects, features and technical advantages are achieved by a system and method which provides for real time sensing and adjustment of the height of the dispensing head with respect to the substrate being coated. This approach permits the inventive method to actively compensate for error in the dispenser independently of the source of such error.

The following discussion refers primarily within the context of adjusting the working height of dispenser, dispensing head, or extrusion head, above the surface of a substrate to be coated, the surrounding machinery being a coating apparatus. The principles discussed herein however, are applicable to the adjustment of a working distance, in any direction including various dimensions of angular motion, of any object to any other object within an apparatus where precise adjustment of the linear or angular distance between the two objects is important to the performance of said apparatus. Although the two objects will often be, respectively, a variety of tool and a workpiece, this is not always the case.

The problem of head gap variation is addressed by employing height sensing means feeding information to a control system which activates a motor or other drive means to drive the dispensing head higher or lower as the sensing data dictates. The height sensor is taught an appropriate "zero" or reference point representing the correct height of the dispensing head. Subsequent deviation from that point results in an error signal causing the control system and motor to correct the dispensing head's height. Preferably, the rate or velocity of adjustment in the height of dispensing head is tempered so as to ensure that the bead of the fluid being dispensed will not be harmed or broken. Sensing means available for this purpose include but are not limited to mechanical contact sensing, optical, air cushion, electromagnetic, hall effect, sonic, and ultrasonic.

It is noted that the dispenser could have several possible configurations including but not limited to an extrusion head with a precisely machined linear slot cut in it for extruding coating fluid in a precisely controllable manner.

In a preferred embodiment the drive means for controlling the height of the dispenser above the substrate to be coated is the same as that which provides larger scale motion of much of the structure holding the dispensing head, such as a shuttle mechanism or other transport system which moves the dispenser along the coating direction over the substrate. This arrangement is economical in that it obviates the need for a second drive means to move the dispenser with respect to the substrate.

Alternatively, a second drive means could be utilized, such as might be attached in between the shuttle mechanism and the dispenser. Preferably, with such an alternate arrangement, the vertical axis of the head gap mechanism or other dispenser mounting apparatus would remain mostly stationary during the coating operation permitting what is preferably a highly precise second drive means to conduct the head gap maintenance operation.

In either of the configurations of drive means discussed, the dispenser may either be attached to the shuttle mechanism or other dispenser mounting apparatus in such a manner as to be readily and rapidly removable therefrom, or it may be more permanently attached to the shuttle mechanism. Sensing the height of the dispenser above the substrate is useful in accurately providing corrective positioning commands to a drive means, whether this drive means is the main drive means for the shuttle as in the preferred embodiment, or a second drive means as in an alternative embodiment.

Height sensing may be accomplished by using the encoder(s) or other position reporting mechanisms typically embedded in motors or other drive means. Such position reporting is necessary for the drive means both for controlling the drive means motion parameters such as velocity and acceleration and in order to accurately arrive at a particular position. The position reporting mechanism of the drive means may be used as the feedback mechanism to conduct real time monitoring of the head gap. This method of position feedback is indirect in the sense that information from a rotary motor encoder or other drive means position reporting system is being received by control means and used to subsequently calculate the head gap which theoretically results from such a motor or drive means position.

In a preferred embodiment, a separate sensing means will be used to more directly and more accurately measure the head gap. This separate sensing means, or height sensing means, will preferably be located on the dispenser itself in order to acquire information about the head gap as precisely as possible. The use of a separate sensor in any position will avoid any inaccuracy in converting position of the drive means, whether it is rotary, linear, or otherwise, into the linear distance of the head above the sensor.

Precision is further aided when the number of variables the sensor is subject to is minimized. Mounting a sensor on the dispenser removes sources of error arising from variation in position of the dispenser with respect to its supporting structure, and variation in position between the drive means and various portions of the supporting structure. Therefore the height sensor is preferably mounted on the dispenser itself. Alternatively, the height sensor could be mounted at a location rigidly attached to the dispenser such as on a portion of the shuttle mechanism. It is noted that the height sensing means of the preferred embodiment is not attached to, and is mechanically independent of, the drive means of the shuttle mechanism.

In a preferred embodiment, the height sensor, or head gap sensor, employs mechanical contact with the substrate to measure the head gap. This mechanical sensor is preferably in the form of a rod with a roller base attached to a linear encoder which measures the rod movement with fine resolution. Other technologies available for head gap sensing are optical, sonic, ultrasonic, electromagnetic, and air cushion. It is noted that mechanical contact sensing experiences less lag time or delay between a change in position and a change in encoder measurement than the competing technologies. In a preferred embodiment of the present invention, there are head gap sensors deployed at multiple locations on the dispenser, such as on both ends of a linear dispensing head which measure and correct the height at their respective locations independently. In the axis of coating motion, the sensors may lead the dispenser so as to prevent disruption of the coating process by the rollers, or disruption in the height sensing process by the coating material.

The presence of a gap, in the coating direction between the surface position whose height is sensed (the sensing point) and the surface position being coated at that instant (the coating point), introduces a possible source of error in the height correction scheme. Assuming instantaneous response by the height sensing and control system, a rise or drop occurring ahead of the coating point will lead to height adjustment error, since the system will raise or lower the coating head prior to the coating head actually reaching the point along the direction of coating head travel where the height change was sensed.

In one preferred embodiment of the invention, the rollers are placed a sufficiently small distance ahead of the dispenser in the coating direction that the delay in reaching a point on the substrate between a height sensing roller and the bead from the dispenser very closely matches the delay inherent in processing the height measurement signal in the control system and commanding a height adjustment mechanism to respond thereto. Note that as processing time decreases, this distance approaches zero. Thus, it is preferable to have the sensors substantially in-line with the coating point, on an un-coated portion of the substrate. Accordingly, no additional, deliberate delay between sensing and appropriately adjusting dispenser height is introduced.

In another preferred embodiment, the rollers are placed sufficiently far ahead of the dispenser, that the control system acts to insert a delay between height sensing and height adjustment to compensate for the delay in dispenser travel time between the position being sensed and the instantaneous position of the dispenser. Employing this control scheme, the control system is always adjusting height based on information received a finite period of time prior to said height adjustment requiring that the system store height information as a function of time for the period of the delay.

In a preferred embodiment of the invention the sensor encoder transmits discrete or digital information to a control means obviating the need to convert some form of energy intensity value in the sensor into digital information usable by a digital computing means. Alternatively, the sensor could employ encoders which convert distance or displacement into quantities including but not limited to voltage, light intensity, air pressure, hydraulic pressure, sonic energy, ultrasonic energy, frequency, and frequency phase shift. The quantity into which distance was converted by the sensor is then preferably ultimately converted into a form usable by a control means, preferably a digital computer. In certain cases, intermediate stages of a signal representing the distance may involve conversion into an analog voltage and subsequent digitization by an analog to digital converter.

A control system using a standard P.I.D. (proportional integral derivative) control scheme, which is well known in the art, acts to monitor and correct the head gap in real time. Appropriate damping is employed while controlling dispenser lifting or moving means so as to avoid abrupt movements which could disturb or break the bead. This control system is preferably a computer system which operates all the equipment in the coating apparatus, or other apparatus. However,. analog control systems and non-electrical control systems could also be employed.

In another preferred embodiment, control of the drive means controlling the head gap during the coating process, or other operation, is conducted by a dedicated processor. Permitting a dedicated processor to control the head gap in real time, liberates a main computer and host software of the need to perform this task and permits the host software to concentrate on other aspects of the coating apparatus, or other machines.

In a preferred sequence of events, the shuttle mechanism would move to a vertical position prior to enablement of the precision locating function. The head gap sensors are then preferably put in place and enabled. Power to the drive means would be disabled and brakes for the drive means turned on. Position feedback for the control system would then preferably be shifted from the drive means encoders to the head gap sensor encoder. Next, control of the height control means, or vertical drive means, would then preferably be shifted to a dedicated processor. The vertical drive means would then be enabled.

The overall apparatus then proceeds with the coating process, moving either the dispenser, the substrate, or some combination of the two, permitting the dedicated processor to monitor and control the head gap, thereby adapting to all height variations arising from any cause during relative travel of the dispenser with respect to the substrate. When the coating run is finished, the above steps are reversed. Specifically, control is returned from the dedicated processor to the host computer or software and position feedback for the drive means is switched from the head gap sensing means to the motor encoder or other drive means position reporting mechanism.

In an alternative embodiment of the present invention, rather than measuring and correcting the head gap in real time, a control system could direct the shuttle mechanism to travel the full coating distance across the substrate without actually coating, measuring the substrate surface height, or anticipated head variation along the way. The control system would continuously measure the head gap as a function of horizontal displacement of the shuttle along the substrate and store this "map" of height variation for future use. Later, when actually running the coating operation, the alternative inventive mechanism would use this height variation map to appropriately adjust the height of the dispenser as it moves across the substrate.

In an alternative embodiment, the height sensing and correction system of the present invention could be employed in any machine or process where maintaining a particular distance between two parts is important to the performance of that machine or process.

Therefore it is a technical advantage of the present invention that the head gap can be accurately established prior to beginning a coating operation.

It is a further technical advantage of the present invention that the head gap can be accurately established independently of any change in the dimension and position of the parts of the coating apparatus over time.

It is a still further technical advantage of the present invention that the head gap can be accurately maintained throughout the performance of a coating operation.

It is a still further advantage of the present invention that the head gap can be accurately maintained during the coating operation independently of any variation in the dimensions of the part to be coated, error in part placement, and imperfect leveling of the structure supporting the part to be coated.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

In understanding the concepts and features of the present invention, reference to specific embodiments is helpful. Accordingly, description of various preferred embodiments of the present invention are provided herein. However, it shall be appreciated that the present invention is not limited to the specific embodiments disclosed herein.

Specifically, the inventive mechanism is not limited to adjusting the height of a dispenser or coating device above a substrate within the context of a coating apparatus. The inventive mechanism is applicable to the need for precise adjustment of the distance, in any direction including angular dimensions, of any part with respect to any other part, in any application in which precisely maintaining such distances is important to the performance of an operation involving the two parts, where either part may be a tool or a workpiece.

Figure 1:
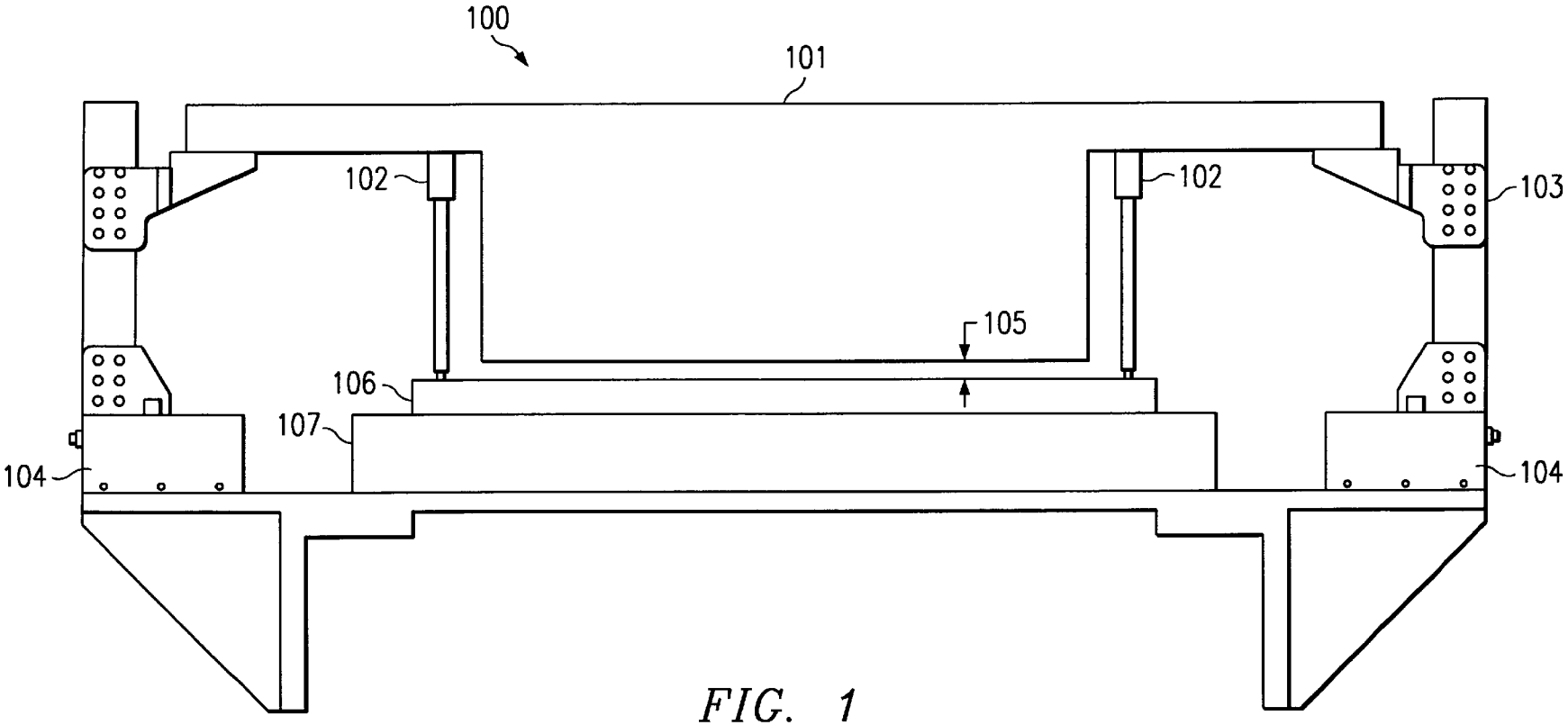
FIG. 1 depicts an end view of the shuttle mechanism holding the dispenser with head gap sensors in place according to a preferred embodiment of the present invention.

FIG. 1 depicts an end view of the shuttle mechanism holding the dispenser with head gap sensors in place according to a preferred embodiment of the present invention. In a preferred embodiment of the present invention two head gap sensors 102 are used, one at each end of the dispenser 101. Alternatively a single sensor could be used, or a number greater than two.

In a preferred embodiment, each of the two head gap sensors is associated with the head lift means 104, meaning the positional information is fed from each sensor 102 to its associated head lift means 104. Since vacuum chuck 107 holds substrate 106, errors in gap 105 could be introduced by variations in the placement, dimension and/or operation of the chuck 107, substrate 106, dispenser 101, and/or by combinations of these elements or other elements of system 100. With this arrangement, the head lift means, or drive means, closest to the point on the dispenser indicating an error in head gap 105 will perform the corrective activity until the sensor which indicated the error reports a correct head gap 105. It is noted that the head gap 105 may vary across the length of the dispenser. An alternative arrangement could involve combining the readings from the sensors and issuing commands to the dispenser lift means 104 which represent a combination of the two sensor readings.

In the preferred embodiment, the sensors 102 are placed as shown, on either side of the dispenser displaced from one another along an axis horizontal perpendicular to a direction of coating motion. In the coating direction, the sensors 102 are located ahead of location of fluid release to avoid having the fluid interfere with the height sensors, and in the case of mechanical contact sensors, to avoid having the sensors disrupt the recently deposited coating fluid. Note that the sensors may be located at the point of fluid release if it is acceptable to have an uncoated band along the side of the substrate.

In a preferred embodiment shown in FIG. 1, the dispenser 101 and the shuttle mechanism are separate parts which can be rigidly attached to one another. Alternatively, the dispenser and shuttle mechanism could be attached permanently to one another forming a single rigid structure. In the preferred embodiment, the head gap sensors 102 are mounted on the dispenser 101 so as to provide the most direct and accurate measurement available of the head gap 105. This configuration minimizes the number of variables which could cause error in the head gap 105 measurement such as variation in position of the shuttle mechanism structure with respect to the dispenser 101. In an alternative embodiment however, the head gap sensors 105, could be mounted on the shuttle mechanism 103, or elsewhere on the coating apparatus.

In a preferred embodiment, the head gap sensors are mechanical contact sensors comprising rods with roller bases which roll along the surface of the substrate 106. These sensors are initially deployed prior to the coating operation by pneumatically extending them into position on the substrate 106. Once coating is complete, the sensors are pneumatically withdrawn. Alternatively, the mechanical sensors could be extended and retracted using a number of power transmission means including but not limited to electric, hydraulic, and gravitational (for extension downward).

In an alternative embodiment, a head gap sensor could comprise a number of different sensing technologies including but not limited to mechanical, optical, sonic, ultrasonic, electromagnetic, and air cushion. In each case an interface appropriate for the technology being employed would convert the physical phenomenon observed into position data usable in a control system for correcting any observed error in head gap 105.

The permissible locations for mounting a head gap sensor depend upon the technology employed. Sensors which inherently measure a distance from their own mounting location, such as the mechanical contact sensors should be mounted in a location which remains fixed with respect to the dispenser fluid orifice. The distance between the sensor mount location and the dispenser orifice would thereby be a constant and can be easily incorporated into any head measurement calculations.

Sensors which measure reflections of an energy source including but not limited to such means as sonic, ultrasonic, light emitters and receivers, and electromagnetic would be subject to the same mounting location restriction. However, a camera which can view the head gap and glean head gap distance data therefrom could be located at any point from which it can view the head gap. Further, a sensor which can measure the height of both the dispenser and the height of the substrate at once need only subtract the two measurements to determine a head gap, and thus could be located at any point where its sensing mechanism can access both the dispenser and the substrate surface near the dispenser.

In a preferred embodiment, relative motion between the dispenser 101 and the substrate 106 is primarily due to the motion of the shuttle mechanism 103 and dispenser 101 over a mostly stationary substrate 106. However, the present invention will accurately set and maintain a head gap 105 regardless of what combination of movement of the shuttle mechanism 103 and the substrate 106 causes the relative motion between the two, including but not limited to the case opposite the preferred embodiment, where the substrate 106 moves under a mostly stationary dispenser 101.

In the preferred embodiment, the dispenser lift means 104, or drive means, is deployed between different portions of the shuttle mechanism 103. The apparatus being lifted by the lift means 104 includes a vertical post structure of the shuttle mechanism, an attachment means for the dispenser, and the dispenser itself. An advantage of locating the lift means as described is that the same lift means is used for large scale movement of the upper part of the shuttle mechanism 103 and the attached dispenser 101 as is used for the microscopic height adjustments necessary for in-process (during coating process or operation) head gap adjustment.

The large scale movement of the upper portion of the shuttle mechanism could take place after a coating operation is complete, and the operation of the overall apparatus requires that the dispenser and upper portion of the shuttle move well clear of the substrate.

In an alternative embodiment, dispenser lifting means could be placed between the upper portion of the shuttle and the dispenser such that the dispenser is substantially all of the equipment which is moved by the dispenser lifting means. This would likely require that a total of two vertical drive means be employed in the overall apparatus. The original lift means located between different parts of the shuttle mechanism 103 would remain and be used for large scale motion of the dispenser, and the additional vertical drive means would be used for the fine position adjustment conducted during the coating operation.

Various alternative embodiments could place drive means for the large and fine scale motion of the dispenser with respect to the substrate at a multitude of possible locations on the shuttle mechanism or elsewhere on the coating apparatus, so long as such means produce the effect of moving the orifice on the dispenser from which fluid emerges up and down with respect to the substrate. Moreover, lift means for large scale motion may be omitted where unnecessary, thus only providing fine scale motion according to the present invention, if desired. This disclosure is not limited to the placement of vertical drive means in any particular location.

Figure 2:
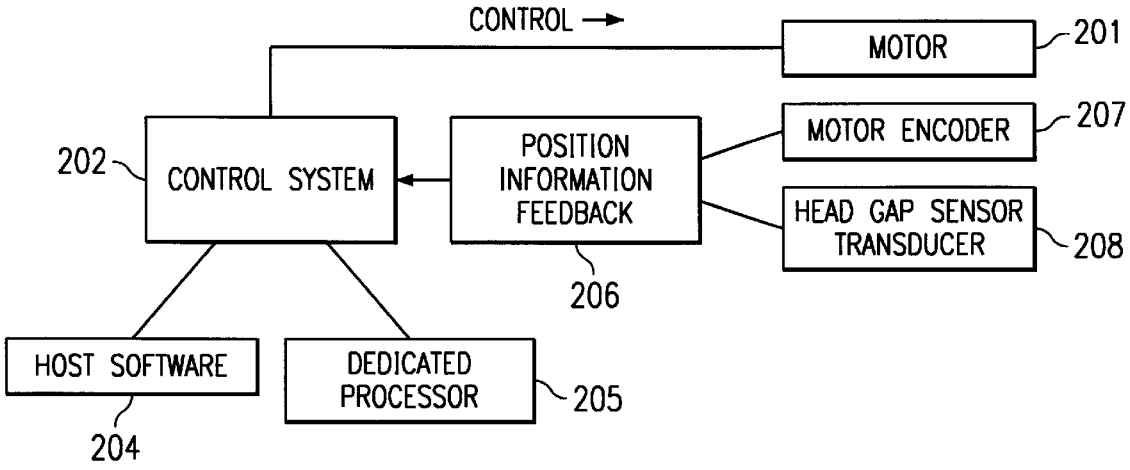
FIG. 2 depicts a control diagram showing elements and connections capable of measuring and controlling the head gap according to a preferred embodiment of the present invention.

FIG. 2 depicts a control diagram showing elements and connections capable of measuring and controlling the head gap according to a preferred embodiment of the present invention. In a preferred embodiment, an electric motor 201 provides vertical drive means to the upper portion of the shuttle mechanism 103. Of course a variety of other sources of powered motion are available including but not limited to pneumatic, hydraulic, and electromagnetic means.

In a preferred embodiment, movement of the upper portion of the shuttle assembly and the dispenser other than during the coating process is accomplished by having the host software 204 conduct motor control using appropriate interfacing equipment which is well known in the art, and receiving position information feedback 206 indicating the position of the motor, and by logical extension, the position of the dispenser and shuttle structure attached thereto, from the motor encoder 207.

In a preferred sequence of operations, before the coating process begins, a shift takes place in the control system 202 and the means for position information feedback 206. In order to free the host software 204 of the burden of conducting head gap measurement in real time, control system 202 is switched from the host software 204 to a dedicated processor 205, which is preferably a motion control board or other subcomponent. In order to measure the head gap more accurately and precisely than is possible with a motor encoder, the position information feedback 206 to the control system 202 is preferably switched from the motor encoder 207 to the head gap sensor transducer 208.

Whichever control device is employed to perform the dispenser height adjustment will use a P.I.D. control scheme to control the dispenser lifting means 104. Appropriate damping is employed within the P.I.D. control scheme to prevent abrupt dispenser movements which would harm or break the coating bead.

In this context, the term transducer is meant to generally describe all mechanisms which convert the physical quantity of head gap into a form which is ultimately comprehensible to a control system. In the preferred embodiment, head gap measurement is achieved using a mechanical contact sensor comprising a rod with a roller base. In this embodiment, the transducer is preferably a highly precise linear encoder. It has been previously observed that other sensing technologies may be substituted for the mechanical contact approach of the preferred embodiment. The transduction means used in each case will accommodate the sensing technology employed. As an non-limiting example, if ultrasonic energy were used for head gap measurement, transduction would comprise that equipment necessary to convert the frequency and/or intensity of the received signal, possibly in comparison with a transmitted signal, into data which can serve as position information feedback 206, comprehensible to the control system 202. The transduction must similarly accommodate any other type of sensory technique used to measure the head gap 105.

The position information feedback 206 must be in a form which is understandable by the control system 202. In a preferred embodiment, such information should be in the form of computer readable digital data. Alternatively, the control system could be equipped with A/D converters or other conversion equipment to convert data other than digital data into a form usable by a digital computer. In yet other alternative embodiments, the control system could be anything which responds to an input representing the head gap and responds to maintain the proper head gap and need not necessarily be a computer or even an electrical device.

In the preferred embodiment, the host software 204 controls the motor 201 or vertical drive means when no coating operation is active and the dedicated processor, preferably a motion control board controls the motor 201 while a coating operation is active. Alternative embodiments may use a dedicated processor for motor control at all times, or host software at all times. Still other alternatives include using manual input at a control station to control motion of the dispenser for large scale movements.

The presence of a gap in the coating direction between the surface position whose height is sensed (the sensing point) and the surface position being coated at that instant (the coating point) introduces a possible source of error in the height correction scheme. Assuming instantaneous response by the height sensing and control system, a rise or drop occurring ahead of the coating point will lead to height adjustment error, since the system will raise or lower the coating head prior to the coating head actually reaching the point whose height was sensed.

In one preferred embodiment of the invention, the sensors 102 are placed a sufficiently small distance ahead of the dispenser 101 in the coating direction that the delay in reaching a point on the substrate 106 between a height sensor 102 and the bead from the dispenser 101 very closely matches the delay inherent in processing the height measurement signal in the control system 202 and commanding a height adjustment mechanism 201 to respond thereto. Accordingly, no additional, deliberate delay between sensing and appropriately adjusting dispenser height is introduced.

In another preferred embodiment, the sensors 102 are placed sufficiently far ahead of the dispenser 101, that the control system 202 acts to insert a delay between height sensing and height adjustment to compensate for the delay in dispenser 101's travel time for the dispenser 101 to reach the position being presently sensed by sensors 102 from the present position of the dispenser 101. Note that the delay depends on the distance between the sensory point and the routing point, the coating velocity, and the inherent processing delay. Employing this control scheme, the control system is always adjusting height based on information received a finite period of time prior to said height adjustment, requiring that the system store height information as a function of time for the period of the delay.

The discussion thus far has assumed sensing for the purpose of real time reaction to surface height variation on the substrate 106. In an alternative embodiment, the control system effectively maps the substrate 106 surface by moving the sensors 102 along the full length of the substrate 106 prior to coating, storing height information as a function of horizontal position, or substrate surface map information, for later use. When conducting the coating operation, the control system 202 employs the map of height plotted against coating direction displacement to anticipate abrupt changes in the surface of the substrate 106, and generate a gradual change in dispenser height so as to protect against damage to the coating bead.

Figure 3:
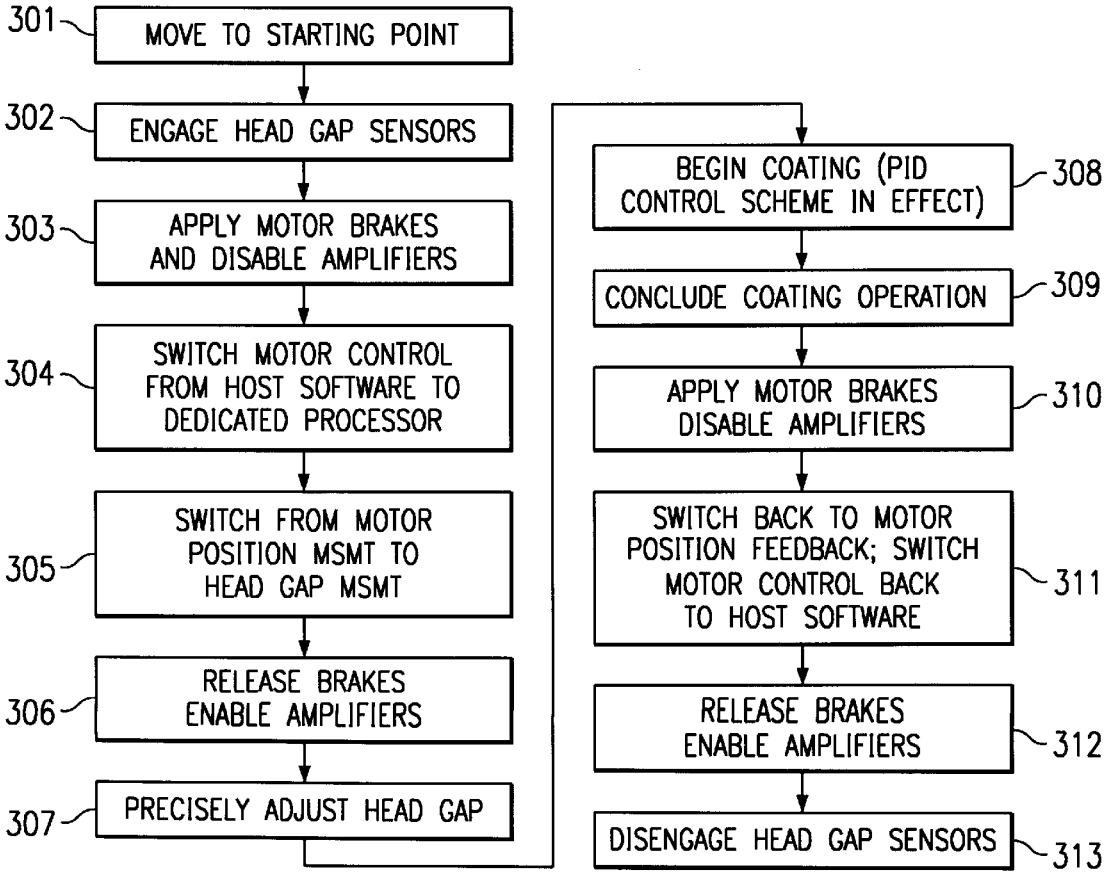
FIG. 3 depicts a flowchart of activity relating to head gap control according to a preferred embodiment of the present invention.

FIG. 3 depicts a flowchart of activity relating to head gap control according to a preferred embodiment of the present invention. In the following, the term "mechanism" is generic to the system and method of the present invention.

At step 301, the mechanism moves the dispenser to a starting point for the coating operation as accurately as the motor encoders or drive means encoders permit. At step 302, the mechanism puts the head gap sensors 102 into place. In the preferred embodiment, the mechanical contact head gap sensors 102 are pneumatically placed into measurement position, specifically, in contact with the substrate 106.

At step 303, in a preferred embodiment, motor brakes are applied, and amplifiers in the motor drive are disabled. In alternative embodiments, the mechanisms enabling power to be applied to various alternative drive means would similarly be disabled.

At step 304, in a preferred embodiment, control of the motor is transferred from the host software to the dedicated processor, preferably a motion control board.

At step 305, the dedicated processor switches its source of position information feedback 206 which is used by to control the dispenser height from the motor encoder, most commonly a rotary encoder, to the head gap sensor transducer which is preferably a linear encoder.

At step 306, the mechanism releases the brakes on the motor and enables the motor amplifiers.

At step 307, the head gap sensors 102 engaged in step 302 are used in conjunction with the dedicated processor 205 and the motor 201 to move the dispenser, if necessary, so as to precisely adjust the head gap.

At step 308, the mechanism begins the coating operation with the control system, preferably the dedicated processor, employing a P.I.D. control scheme to accurately maintain the head gap 105.

At step 309, the coating operation is completed. At step 310, the mechanism applies the motor brakes and disables the motor amplifiers.

At step 311, the source of position information feedback 206 is switched from the head gap sensor transducer to the motor encoder, and control of the motor is switched from the dedicated processor to the host software. At step 312, the mechanism releases the brakes and enables the motor amplifiers.

At step 313, the mechanism disengages the now inactive head gap sensors. The sensors are inactive in the sense that they are no longer providing a feedback signal upon which causes the motor to move.

Figure 4:
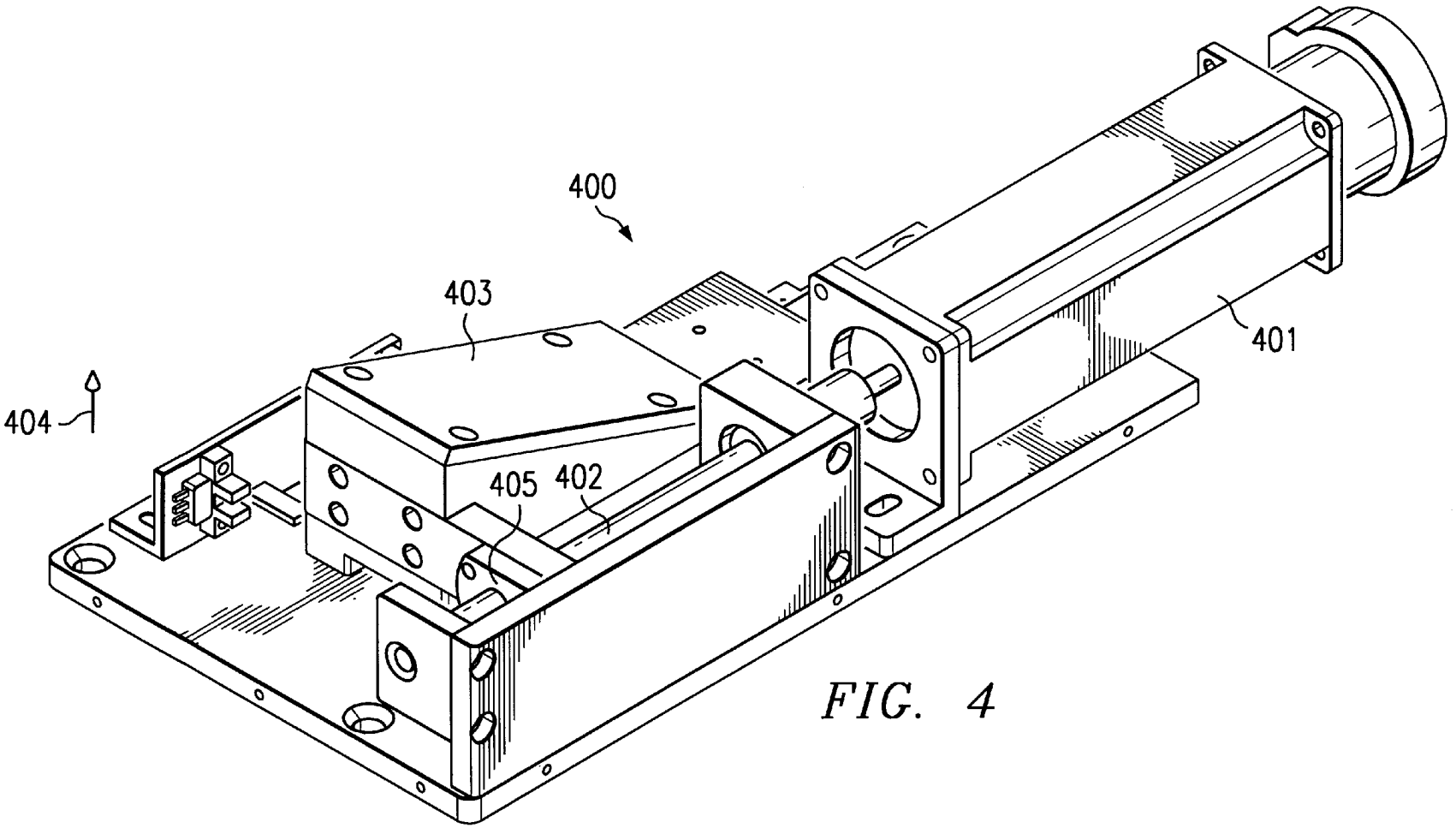
FIG. 4 depicts a preferred embodiment of the dispenser lift gearing apparatus according to a preferred embodiment of the present invention.

FIG. 4 depicts a preferred embodiment of the dispenser lift gearing apparatus 400 according to a preferred embodiment of the present invention. The motor or drive means 401 turns the ball screw 402 which linearly displaces the ballnut 405 which is rigidly attached to the inclined plane 403. The inclined plane 403 moves back and forth parallel to the axis of the shaft 402 and lead screw 401. A surface (not shown) place upon the inclined plane 403, preferably having roller contact with the inclined place 403, and whose motion is restricted in all directions but that perpendicular the dispenser lift gearing apparatus, will move in the lift direction 404 when the inclined plane is moved along the linear axis of the leadscrew.

This configuration places two gearing mechanisms in series thereby permitting finely tuned motion in the lift direction 404 with rotation of the ballscrew 402. The actual ratio of linear distance moved in the lift direction 404 to angular motion of the ballscrew 402 will depend upon the pitch of the ballscrew 402 and the angle of the inclined plane 403, which parameters may be selected in order to optimize the precision and performance of the height adjustment mechanism.

Although the present invention and its advantages have been described in detail, it should be understood that various changes, substitutions and alterations can be made herein without departing from the spirit and scope of the invention as defined by the appended claims.

What is claimed is:

1. Apparatus for ensuring a head gap between a dispenser and a surface to be coated in a coating operation, the apparatus comprising:

a sensor for measuring the head gap, wherein said sensor is a head gap sensor;

means for generating relative motion between said dispenser and said surface to be coated;

a control system for controlling said generating means; and position feedback means integrally incorporated into said means for generating.

2. The apparatus of claim 1, wherein said dispenser has a length, the apparatus further comprising a plurality of sensors for measuring the head gap at a plurality of locations along the length of the dispenser.

3. The apparatus of claim 2, further comprising:

a plurality of means for generating relative motion; and a plurality of control systems, wherein the head gap at each of the plurality of locations is adjusted independently of the head gap at others of the plurality of locations, by a means for generating and a control system.

4. The apparatus of claim 1, wherein the sensor is mounted on the dispenser.

5. The apparatus of claim 4, wherein the sensor employs mechanical contact means to measure the head gap.

6. The apparatus of claim 1, wherein the sensor employs optical means to measure the head gap.

7. The apparatus of claim 1, wherein the means for generating is an electric motor.

8. The apparatus of claim 1, wherein the means for generating comprises only one moving apparatus.

9. The apparatus of claim 1, wherein the control system employs feedback information from said head gap sensor to control said means for generating during the coating operation, and from said integrally incorporated position feedback means otherwise.

10. The apparatus of claim 9, wherein the control system is implemented in a dedicated processor during the coating operation, and in host software otherwise.

11. The apparatus of claim 1, wherein the control system is implemented in host software.

12. The apparatus of claim 1, wherein the control system is implemented in a dedicated processor.

13. The apparatus of claim 1, wherein the control system is implemented in a combination of host software and a dedicated processor.

14. The apparatus of claim 1, wherein the control system is implemented in a dedicated processor during the coating operation, and in host software otherwise.

15. A system for controlling a distance between a tool and a workpiece in a manufacturing apparatus during a manufacturing process, the system comprising:

means for sensing the distance between the tool and the workpiece;

means for generating relative motion between the workpiece and the tool;

first control means for controlling the means for generating based on a measurement of the means for generating to perform large scale relative movement of the tool with respect to the workpiece; and second control means for precisely controlling the means for generating based on the means for sensing to generate fine relative motion of the tool with respect to the workpiece, wherein:

the manufacturing apparatus is a coating apparatus;

the manufacturing process is a coating process;

the tool is a dispenser that dispenses a fluid in the coating process;

the workpiece is a substrate with a surface suitable for coating with the fluid;

the distance is a gap between the dispenser and substrate;

the means for generating relative motion comprises means for moving the dispenser with respect to a stationary substrate; and wherein the means for moving is an electric motor which has a position and the means for sensing the gap comprises a rotary encoder which measures the position of the electric motor.

16. A system for controlling a gap between a dispenser and a substrate in a coating apparatus during a coating process, the system comprising:

a gap sensor for directly measuring said gap between said dispenser and said substrate;

means for generating relative motion between said dispenser and said substrate;

first control means for controlling said means for generating based on a measurement of said means for generating to generate large scale relative motion between said dispenser and said substrate; and second control means for precisely controlling the means for generating based on the gap sensor to generate fine relative motion of the dispenser with respect to the substrate, wherein the means for generating relative motion comprises means for moving the dispenser with respect to a stationary substrate and wherein the gap sensor measures a separation between a sensor mount located on the dispenser and a point on a surface of said substrate.

17. The system of claim 16 wherein the means for generating comprises a single unit that generates both large scale and fine relative motion between the dispenser and the substrate.

18. The system of claim 16 wherein the means for generating comprises:

a first unit that generates large scale relative motion between the dispenser and the substrate; and a second unit that generates fine relative motion between the dispenser and the substrate.

19. The system of claim 16 wherein the gap sensor comprises:

means for converting the gap into a quantity measurable within the gap sensor, thereby generating a locally measurably quantity; and means for converting said locally measurable quantity into gap measurement information suitable for input to the second control means.

20. The system of claim 19, further comprising:

means for moving the gap sensor along a length of the substrate surface to be coated during a non-dispensing operation;

means for continously storing sensor measurement information while moving along said length of said substarte surface, said substrate surface having a height; and means for mapping the substrate surface height as a function of sensor position along said substrate surface, thereby generating a substrate surface height map.

21. The system of claim 20, further comprising:

means for coating the substrate with a fluid while adjusting a dispenser position according to the substrate surface height map.

22. The system of claim 19, wherein the gap sensor comprises:

a mechanical conta ct; and an encoder for supplying position information to the second control means.

23. The system of claim 22, wherein:

the mechanical contact includes a rod with a base in rolling contact with the substrate surface; and the encoder is a precision linear encoder, thereby establishing a roller-based contact sensor.

24. The system of claim 23, further comprising:

a plurality of roller based contact sensors, wherein rollers of said sensors contact the substrate surface ahead of the dispenser along a direction of dispenser travel.

25. The system of claim 24, wherein said rollers are disposed in proximity to a point of fluid deposition without disrupting said fluid deposition.

26. The system of claim 19, wherein the means for converting the gap into the locally measurable quantity is selected from the group consisting of:

mechanical, optical, electromagnetic, air pressure, sonic, and ultrasonic.

27. The system of claim 19, wherein the second control means uses said gap measurement information to correct the gap in real time.

28. The system of claim 27, wherein the second control means employs a P.I.D. control mechanism to control the gap.

29. The system of claim 28, wherein the P.I.D. control mechanism comprises:

means for damping control output to said means for moving to protect a coating bead formed from a fluid.

30. The system of claim 27, wherein the second control means inserts a delay between receiving the gap measurement information and transmitting a control output to said means for generating.

31. The system of claim 27, wherein the second control means transmits control output to said means for generating based on said gap measurement information.

32. The system of claim 16 further comprising:

at least one additional gap sensor mounted to the dispenser, wherein each gap sensor is independently associated with the means for generating, and the second control means acts to maintain the gap at each of said plurality of points.

33. The system of claim 32, wherein said at least one additional gap sensor comprises only one additional gap sensor.

34. The system of claim 16, wherein said second control means comprises:

host software.

35. The system of claim 16, wherein said second control means comprises:

a dedicated processor.

36. The system of claim 16, wherein said second control means comprises:

host software and a dedicated processor.

* * * * *